US007794365B2

(12) United States Patent
Daniel

(10) Patent No.: US 7,794,365 B2
(45) Date of Patent: Sep. 14, 2010

(54) COLLAPSIBLE TRAINING DEVICE AND METHOD

(76) Inventor: Nir Daniel, 3 Belkind Street, Tel-Aviv 69154 (IL)

( * ) Notice: Subject to any disclaimer, the term of this patent is extended or adjusted under 35 U.S.C. 154(b) by 70 days.

(21) Appl. No.: 12/096,291

(22) PCT Filed: Dec. 5, 2006

(86) PCT No.: PCT/IL2006/001399

§ 371 (c)(1),
(2), (4) Date: Jun. 5, 2008

(87) PCT Pub. No.: WO2007/066330

PCT Pub. Date: Jun. 14, 2007

(65) Prior Publication Data

US 2009/0318270 A1 Dec. 24, 2009

Related U.S. Application Data

(60) Provisional application No. 60/748,151, filed on Dec. 8, 2005.

(51) Int. Cl.
*A63B 22/06* (2006.01)

(52) U.S. Cl. ..... 482/57; 482/910

(58) Field of Classification Search ..... 482/57–65, 482/51, 910

See application file for complete search history.

(56) References Cited

U.S. PATENT DOCUMENTS

| | | | | |
|---|---|---|---|---|
| 3,758,107 | A * | 9/1973 | Potgieter | 482/63 |
| 3,874,657 | A | 4/1975 | Niebojewski | |
| 4,061,460 | A * | 12/1977 | George | 425/459 |
| 4,300,761 | A * | 11/1981 | Howard | 482/57 |
| 4,577,860 | A * | 3/1986 | Matias et al. | 482/57 |
| 4,592,544 | A * | 6/1986 | Smith et al. | 482/64 |
| 4,593,898 | A * | 6/1986 | McLerran et al. | 482/61 |
| 4,757,988 | A | 7/1988 | Szymski | |
| 5,595,554 | A | 1/1997 | Maresh | |
| 5,683,332 | A | 11/1997 | Watterson | |
| 5,692,994 | A * | 12/1997 | Eschenbach | 482/57 |
| 7,175,570 | B2 | 2/2007 | Lull | |
| 2003/0050152 | A1 * | 3/2003 | Sze | 482/57 |
| 2003/0069110 | A1 | 4/2003 | Chang | |
| 2003/0211917 | A1 | 11/2003 | Cui | |

FOREIGN PATENT DOCUMENTS

| | | |
|---|---|---|
| FR | 1 185 846 | 8/1959 |
| GB | 1 303 340 | 1/1973 |
| GB | 2 138 920 | 10/1984 |

OTHER PUBLICATIONS

International Search Report of Application No. PCT/IL06/01399 issued on Apr. 21, 2008.
European Search Report of Application No. EP 06 82 1618 mailed on Jul. 6, 2009.
International Preliminary Report on Patentability of Application No. PCT/IL2006/001399 mailed on Mar. 19, 2009.

* cited by examiner

*Primary Examiner*—Steve R Crow
(74) *Attorney, Agent, or Firm*—Pearl Cohen Zedek Latzer, LLP

(57) ABSTRACT

A collapsible training device and method are disclosed. The training device is of the cycling type and may be fully folded into a relatively small and aesthetic stowing cabinet when not in use leaving the room free and nice or may be opened to a workout position when training is carried out.

3 Claims, 5 Drawing Sheets

COLLAPSIBLE TRAINING DEVICE AND METHOD

CROSS-REFERENCE TO RELATED APPLICATIONS

This application is a National Phase Application of PCT International Application No. PCT/IL2006/001399, International Filing Date Dec. 5, 2006, entitled "Collapsible Training Device and Method" published on Jun. 14, 2007 as International Publication Number WO 2007/066330, claiming priority of U.S. Provisional Patent Application No., 60/748,151, filed Dec. 8, 2005, both of which are incorporated herein by reference in their entirety.

BACKGROUND

Nowadays indoor training devices, such as a spinning device, a treadmill training device and the like, suffer of some drawbacks the most disturbing of them in the daily routine of a user is the space they require in the home or the office where they are installed. An invention that allow for reducing of the space required for such training device when not in use is therefore of great importance.

SHORT DESCRIPTION OF THE DRAWINGS

The subject matter regarded as the invention is particularly pointed out and distinctly claimed in the concluding portion of the specification. The invention, however, both as to organization and method of operation, together with objects, features and advantages thereof, may best be understood by reference to the following detailed description when read with the accompanied drawings in which:

Figure 1:
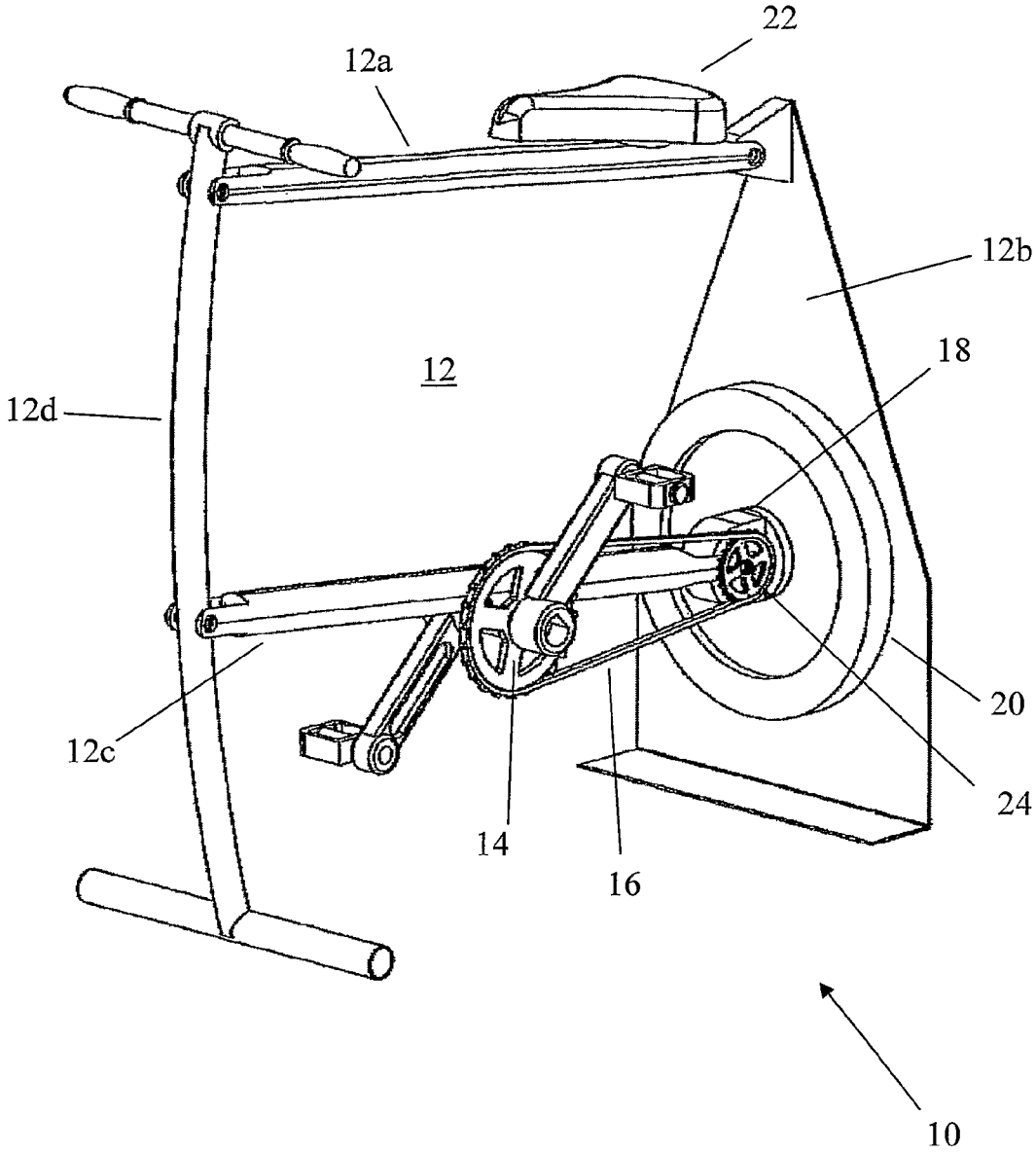
FIG. 1 is a schematic illustration of a training device in its open position, according to some embodiments of the present invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE INVENTION

Indoor training devices of the known art, such as a spinning device, require a considerable space for installation. While in use the space required for the device is unavoidable, the same space, when the device is not in use, is a nuisance, that disturb the user and other people who use that space and may even cause a potential user to refrain from installing such training device or remove pone that has already been installed.

The present invention discloses devices and methods for solving this problem, as well as other aspects, such as aesthetic aspects. Attention is made to FIG. 1, which is a schematic illustration of a collapsible training device 10 in its open position, according to some embodiments of the present invention. Collapsible training device 10 may comprise a collapsible main frame 12 comprising frame sub-units 12*a*, 12*b*, 12*c* and 12*d*, a pedal mechanism 14, a driving chain 16, a driving gear 18, a flywheel 20 and a seat 22. Collapsible 12 may comprise 3 or more sub-units. In the example depicted in FIG. 1 collapsible frame 12 comprises of a top sub-unit 12*a*, a back sub-unit 12*b*, a bottom sub-unit 12*c* and a front sub-unit 12*d*. The four sub-units 12*a*-12*d* are pivotally connected to construct a collapsible parallelogram frame in which sub-units 12*a* and 12*c* are substantially parallel to each other and sub-units 12*b* and 12*d* are substantially parallel to each other. Accordingly, the angle between each consecutive pair of sub-units of frame 12 may be changed. When frame 12 is in its fully unfolded position that angle is substantially a right angle, but these angles of the unfolded position may be set to a different set of angles as desired. When in unfolded position sub-units 12*b* and 12*d* may further function as supporting legs for device 10. Further, sub-unit 12*b* may further be used to affix device 10 a stabilizing steady part, such as a wall of a room (not shown) or the like. Front sub-unit may be used, as depicted in FIG. 1, for the installation of the user's handles. Top sub-unit 12*a* may also be used for supporting user's seat 22. Bottom sub-unit 12*c* may be used for supporting the pedal mechanism 14. Back sub-unit 12*b* may also be used to support driving gear 18 and flywheel 20 which may be installed with its turning axis substantially parallel to sub-units 12*a* and 12*c* when device 10 is in its unfolded position, thus allowing installation close to sub-unit 12*b* and minimal protruding when device 10 is in stowed away position. According to some embodiments of the invention the axis of the driven toothed wheel 24 in driving gear 18 may serve as the pivotal connection between sub-units 12*b* and 12*c*.

Figure 2:
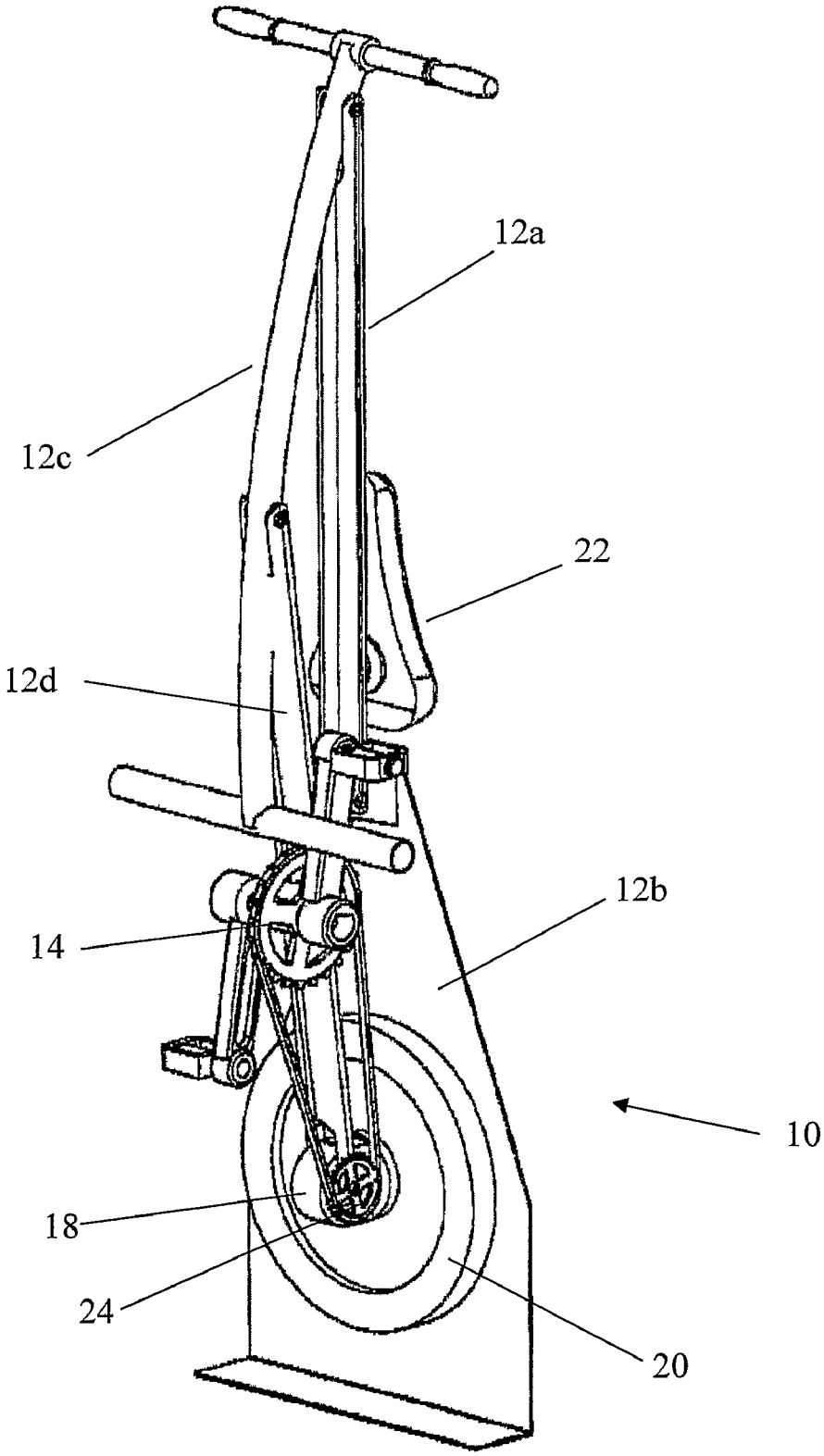
FIG. 2 is a schematic illustration of a training device in its collapsed position, according to some embodiments of the present invention.

Attention is made now to FIG. 2, which is a schematic illustration of a training device 10 in its collapsed position, according to some embodiments of the present invention. Based on the collapsible parallelogram construction of frame 12, when device 10 is collapsed to its up-right position, as depicted in FIG. 2, its size may be minimized, and if it is installed next to a wall, it may then be collapsed to a small up-right collapsed frame by the wall thus leaving most of its formerly occupied space free.

Figure 3:
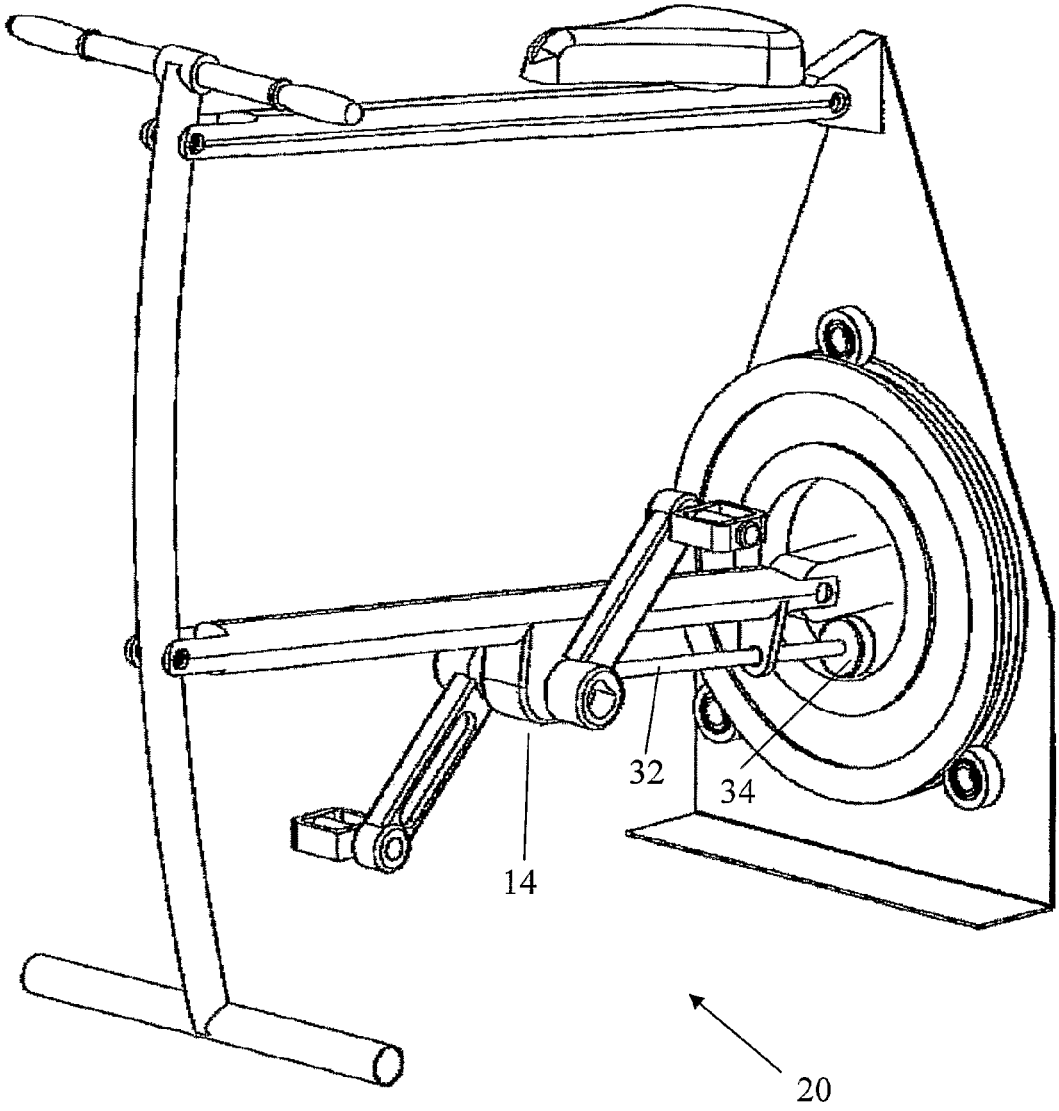
FIG. 3 is a schematic illustration of a training device in its open position, according to some embodiments of the present invention.
Figure 4:
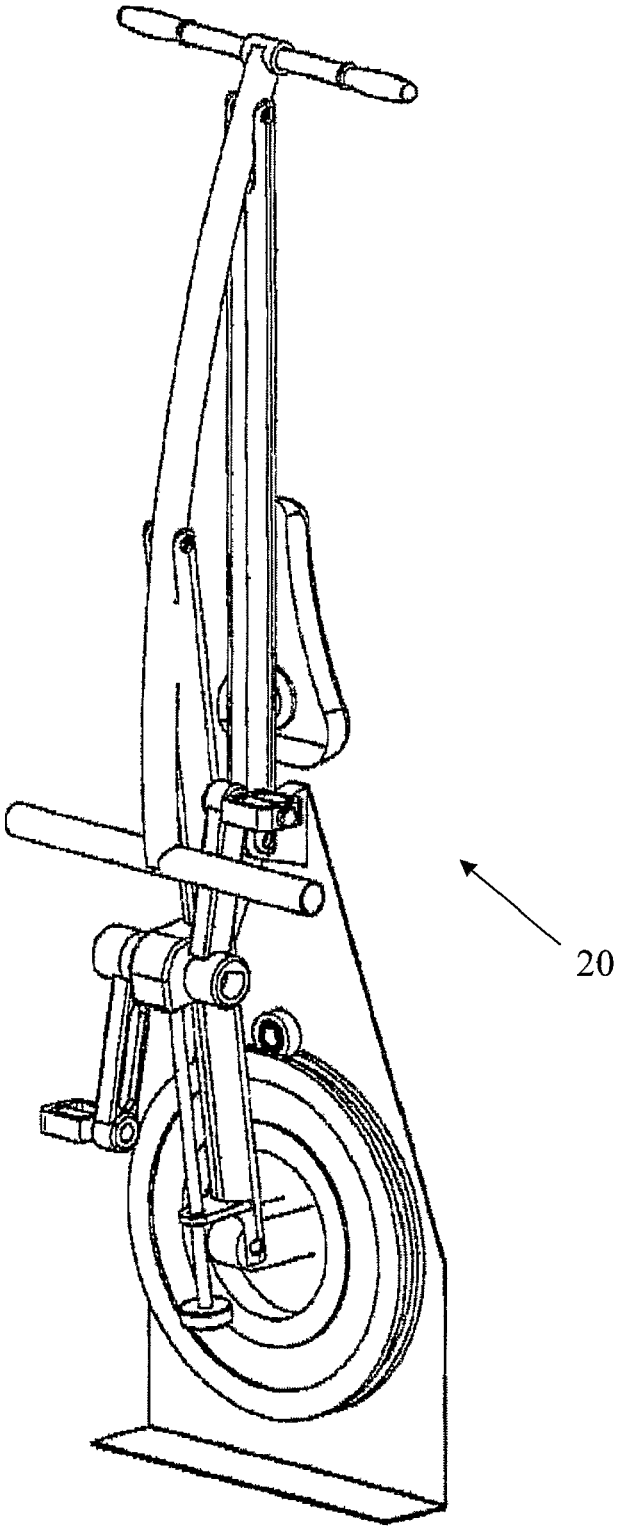
FIG. 4 is a schematic illustration of a training device in its collapsed position, according to some embodiments of the present invention.
Figure 5:
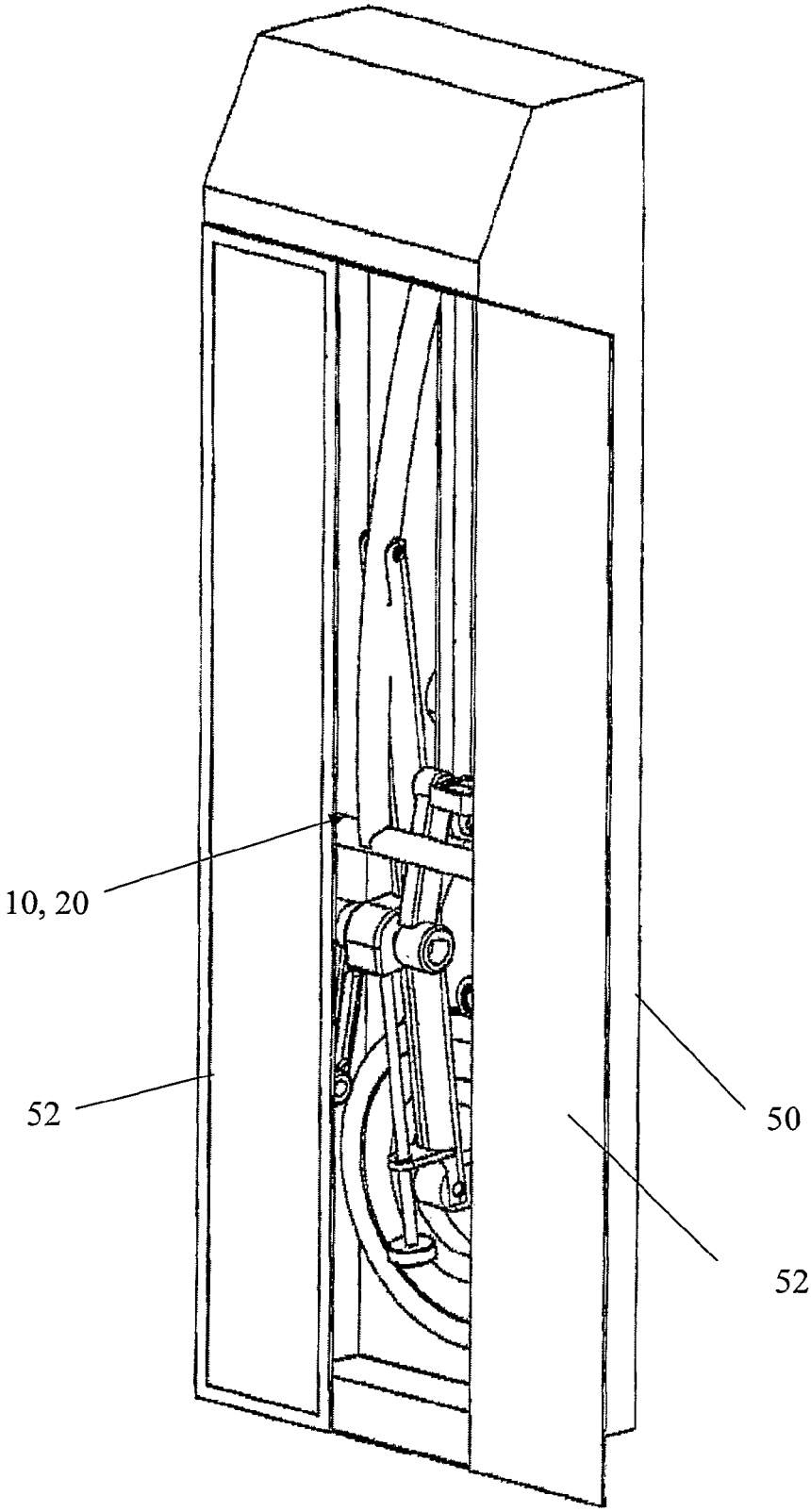
FIG. 5 is a schematic illustration of a training device in a stowed away position, according to some embodiments of the present invention.

Attention is made now to FIGS. 3 and 4, which are a schematic illustration of a training device 20 in its open position and a schematic illustration of that training device in its collapsed position, respectively, according to some embodiments of the present invention. In the embodiment of FIGS. 3 and 4 the mechanism of driving flywheel 20 comprises a worm gear rotatable by pedal mechanism 14, a drive shaft 32 and a friction wheel 34. While in the depicted example of device 20 the method of driving the flywheel is different from that of device 10, aspects of the present invention addressing device and method for a collapsible training device are kept in both examples. It should be noted that either the driving mechanism of FIGS. 1 and 2 or that of FIGS. 3 and 4 the folding of frame 12 to a fully collapsed position or opening frame 12 to a fully opened working position are possible without any obstruction. In the driving mechanism embodiment of FIGS. 1 and 2 driven toothed wheel 24 and driving gear 18 may have their input axis coaxial with the corresponding pivot joining frame members 12*b* and 12*c* and thus allowing free opening or collapsing of frame 12. In the embodiment of FIGS. 3 and 4 friction wheel 34 is placed so that when frame 12 is closed to a collapsed position it departs from flywheel 20 and when frame 12 is opened to an open working position friction wheel 34 engages flywheel 20 to a rotatable coupling. Attention is made now to FIG. 5, which is a schematic illustration of a training device 10, 20 in a stowed away position, according to some embodiments of the present invention. In cases where not only saving of space of device 10, 20 when not in use is important but also the aesthetic aspect, device 10, 20 may be stowed away in a cabinet 50 built with front openings, such as doors 52, to allow easy pulling out or stowing way of device 10, 20 as required.

What is claimed is:

1. A device comprising:

a collapsible main frame adapted to fold to a folded position and to unfold to an unfolded position comprising:

at least top and bottom sub-units substantially parallel to each other; and a driving mechanism, said driving mechanism comprising:

a pedal mechanism;

a gear; and a flywheel rotatable by said gear;

wherein the turning axis of said flywheel is substantially parallel to said top and said collapsible main frame further comprises a back sub-unit member and a front sub-unit member forming a parallelogram with said top and bottom sub-units, each said top and bottom sub-unit pivotally connected at their respective ends to the front and back sub-units; said parallelogram is adapted to be stowed in a stowing cabinet when in a collapsed position and to allow using said device for training when in an opened position.

2. The device of claim 1 wherein said gear is rotatable by said pedal mechanism.

3. The device of claim 1 wherein said flywheel is rotatable via a one of worm gear and a friction wheel.

* * * * *